US012589783B2

(12) United States Patent
Na et al.

(10) Patent No.: US 12,589,783 B2
(45) Date of Patent: Mar. 31, 2026

(54) LIGHT TRAIN CONTROL SYSTEM APPLIED TO OVERSEA FREIGHT RAILWAYS

(71) Applicant: CASCO SIGNAL LTD., Shanghai (CN)

(72) Inventors: Jiqing Na, Shanghai (CN); Tao Wang, Shanghai (CN); Zhixin Chen, Shanghai (CN); Yajing Zhang, Shanghai (CN); Liang Guo, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 622 days.

(21) Appl. No.: 18/003,851

(22) PCT Filed: Sep. 23, 2021

(86) PCT No.: PCT/CN2021/119765

§ 371 (c)(1),
(2) Date: Dec. 29, 2022

(87) PCT Pub. No.: WO2022/134686

PCT Pub. Date: Jun. 30, 2022

(65) Prior Publication Data

US 2023/0278603 A1 Sep. 7, 2023

(30) Foreign Application Priority Data

Dec. 22, 2020 (CN) ..... 202011525612.4

(51) Int. Cl.

| | |
|---|---|
| ***B61L 15/00*** | (2006.01) |
| ***B61L 23/16*** | (2006.01) |
| ***B61L 25/02*** | (2006.01) |
| ***B61L 27/20*** | (2022.01) |
| ***B61L 27/70*** | (2022.01) |

(52) U.S. Cl.

CPC ..... *B61L 15/0054* (2013.01); *B61L 15/0027* (2013.01); *B61L 23/16* (2013.01);

(Continued)

(58) Field of Classification Search

CPC .. B61L 15/0054; B61L 15/0027; B61L 23/16; B61L 25/025; B61L 27/20;

(Continued)

(56) References Cited

U.S. PATENT DOCUMENTS 5,420,883 A * 5/1995 Swensen ..... G01S 5/0009 375/138
5,828,979 A * 10/1998 Polivka ..... B61L 27/14 246/5

(Continued)

FOREIGN PATENT DOCUMENTS

CN 109017877 A * 12/2018 ..... B61L 15/0054
CN 109677466 A 4/2019

(Continued)

OTHER PUBLICATIONS

International Search Report (with English translation) and Written Opinion issued in PCT/CN2021/119765, dated Nov. 22, 2021, 12 pages provided.

(Continued)

*Primary Examiner* — Kurt Philip Liethen
(74) *Attorney, Agent, or Firm* — HSML P.C.

(57) ABSTRACT

The disclosure relates to a light train control system applied to oversea freight railways. The system integrates automatic block, station turnout control and train operation overspeed protection control and comprises an on-board subsystem, an RBC subsystem and a satellite positioning differential base station management subsystem, wherein the on-board subsystem is respectively connected to the RBC subsystem and the satellite positioning differential base station management subsystem. The light train control system adopts two-way continuous train-ground wireless communication and uses on-board signals as main signals of train operation to control the train operation; meanwhile, the system monitors the train operation, so as to provide an alarm to a driver when the (Continued)

situation changes, and to brake a train when necessary; and the system uses an electronic map to manage line data of a whole line, achieves dynamic configuration of the transport capacity by means of a virtual block technology, and remotely controls basic signaling equipment by means of an RBC. Compared with the prior art, the disclosure has the advantages of efficient system operation and simplified trackside equipment.

11 Claims, 2 Drawing Sheets

(52) U.S. Cl.
CPC ..... *B61L 25/025* (2013.01); *B61L 27/20* (2022.01); *B61L 27/70* (2022.01); *B61L 2205/04* (2013.01)

(58) Field of Classification Search
CPC ..... B61L 27/70; B61L 2205/04; B61L 2027/202; B61L 2027/204; B61L 2205/02; B61L 5/00; B61L 15/00; B61L 2205/00
See application file for complete search history.

(56) References Cited

U.S. PATENT DOCUMENTS 11,140,553 B1 * 10/2021 Taylor ..... H04W 12/122
2002/0062181 A1 * 5/2002 Polivka ..... B61L 27/20 701/19
2009/0230254 A1 * 9/2009 Daum ..... B61L 27/20 701/19
2013/0090801 A1 4/2013 Backes et al.
2015/0142225 A1 * 5/2015 Tonguz ..... B61L 19/06 701/19
2015/0249948 A1 * 9/2015 Yamamoto ..... H04W 36/324 455/441
2016/0200327 A1 * 7/2016 Liu ..... B61L 21/00 705/13
2019/0168788 A1 * 6/2019 Ghaly ..... B61L 27/20
2020/0189630 A1 * 6/2020 Kernwein ..... B61L 15/0054

FOREIGN PATENT DOCUMENTS

CN 112572533 A 3/2021
DE 102018115373 A1 * 1/2019 ..... B61L 25/025

OTHER PUBLICATIONS

Liu et al., "Talking about Qinghai-Tibet Railway Communication Signal System", Railway Signalling & Communication, Nov. 31, 2013, vol. 49, pp. 118-121 with English translation.
Zhang et al., "Key technology research of CTCS-4 level train control system based on ITCS", Railway Signalling & Communication, Jul. 17, 2018, vol. 54, No. 7, pp. 61-65, with English translation.
Kai Xiangbao et al., "An Architecture Design of the Train Control System based on BDS", Railway Transportation and Economy, vol. 40, No. 10, pp. 66-70, with English translation.

* cited by examiner

LIGHT TRAIN CONTROL SYSTEM APPLIED TO OVERSEA FREIGHT RAILWAYS

FIELD OF TECHNOLOGY

The disclosure relates to the field of train control systems, in particular to a light train control system applied to oversea freight railways.

BACKGROUND

On the basis of the consideration of enhancing the safety, improving the efficiency and reducing the cost, the United States, the European Union and Japan have successively started the research on next generation train control systems. The systems that have been studied or started to be deployed include: the European Next Generation Train Control System (NGTC), the American Positive Train Control System (PTC) and the Japanese Advanced Train Administration and Communications System (ATACS). Both the European Train Control System (ETCS) and the PTC plan to adopt the satellite positioning technology. With regard to high-density train control systems, the ETCS uses satellite positioning as an enhanced odometer, and the PTC entirely relies on its positioning. With regard to low-density train control systems, especially suburban or freight lines, the satellite positioning technology has become a main support of the train control systems. With the development of the satellite positioning technology, various foreign mainstream train control suppliers have also run the train control systems or projects using the satellite positioning technology, which mainly include the Incremental Train Control System (ITCS) of GE in America, the ATLAS400 system of Alstom in France, the railGATE project involving Siemens in Germany, and the 3INSAT project involving Ansaldo in Italy.

At present, train positioning is mainly carried out in the following manners: track circuit positioning, satellite navigation positioning, axle counter positioning, induction loop on-board sensors, map matching positioning, speed measurement positioning, wireless positioning, query balise positioning, and train positioning based on wireless communication. According to the analysis of the various positioning manners, track circuits and axle counters are relatively high in safety, but relatively poor in accuracy; query balises are relatively high in accuracy, but require a large quantity of auxiliary equipment, which results in the relatively poor maneuverability; the cross induction loop positioning may avoid the interference of traction currents and greatly improve the anti-interference capability of the positioning systems, but require a lot of cables, which results in the relatively large maintenance workload in the later period; the speed measurement positioning, the wireless positioning, map matching and the satellite positioning are relatively good in maneuverability, but also have respective defects, accumulation of errors caused by the speed measurement positioning to speed integrals leads to reduction of the accuracy, the reliability of the wireless positioning needs to be further improved, the satellite positioning is greatly affected by the environment, and the map matching has the relatively high requirements for the accuracy of matched digital maps.

Oversea mine railways are easy to operate and manage and relatively low in traffic density, with the operation speeds generally not exceeding 120 km/h. Traditional train control systems are complex in equipment configuration, construction involves a large range, investment and maintenance costs are high, and most functions are not applicable to the mine railways. In addition, the oversea mine railways are hostile in operation environment, vast in territory, sparse in population and high in outdoor equipment maintenance difficulty and are seriously damaged by the environment and humans. Therefore, the demands for efficient operation of the train control equipment, simplified trackside equipment and centralized indoor equipment is particularly prominent in demands of the oversea mining railways.

SUMMARY

The present disclosure aims to overcome the above-mentioned defects of the prior art to provide a light train control system applied to oversea freight railways and capable of realizing efficient system operation, simplified trackside equipment and centralized indoor equipment.

The purpose of the present disclosure can be achieved through the following technical solution:

the light train control system applied to oversea freight railways, the system integrating automatic block, station turnout control and train operation overspeed protection control and comprising an on-board subsystem, an RBC subsystem and a satellite positioning differential base station management subsystem, wherein the on-board subsystem is respectively connected to the RBC subsystem and the satellite positioning differential base station management subsystem by means of on-board equipment external interfaces;

the light train control system adopts two-way continuous train-ground wireless communication and uses on-board signals as main signals of train operation to control the train operation; meanwhile, the system monitors the train operation, so as to provide an alarm to a driver when the situation changes, and to brake a train when necessary; and the system uses an electronic map to manage line data of a whole line, achieves dynamic configuration of the transport capacity by means of a virtual block technology, and remotely controls basic signaling equipment by means of an RBC.

Preferably, the on-board subsystem comprises on-board host OBS and on-board peripheral equipment, and the on-board peripheral equipment is connected to the on-board equipment external interfaces by means of the on-board host OBS.

Preferably, the on-board equipment external interfaces include a train interface, a power interface, an RBC interface, a GNSS interface and a balise interface.

Preferably, the on-board host OBS comprises an ATP master control unit and a speed and distance measurement unit, a balise information receiving unit, a train integrity receiving unit, a data recording unit, a train interface unit, a wireless transmission unit and a satellite receiving unit which are respectively connected to the ATP master control unit; and the on-board host OBS determines the speed and the position by combining satellite information, a balise and a speed sensor to measure the speed and the distance.

Preferably, the on-board peripheral equipment comprises a man-machine interface unit, the speed sensor, a balise information receiving antenna, a wireless antenna and a satellite receiving antenna.

Preferably, the on-board host OBS completes train integrity inspection by means of satellite positioning and air pressure detection.

Preferably, the RBC subsystem comprises a radio block center (RBC), which sends movement authority to the train through a communication network by means of RBC remote driving, collection of the state of a station turnout, the state of a signal and the state of a track circuit and combination with the stored line data and a position report sent by the station.

Preferably, the communication network comprises DMR, VHF and TETRA communication modes.

Preferably, the system realizes the train-ground wireless communication and wireless communication between the on-board host OBS and train tail equipment in the low-density freight railways by means of a DMR digital co-frequency relay technology.

Preferably, the system uses balise information as a reference point to report a train position in the station and a section with a balise, and uses a virtual balise as a reference train position report in a section without the balise.

Compared with the prior art, the present disclosure has the following advantages:

1. the system integrates the automatic block, the station turnout control and the train operation overspeed protection control, adopts the two-way continuous train-ground wireless communication and uses the on-board signals as the main signals of the train operation to control the train operation, and has the high integration degree;
2. the system monitors the train operation, so as to provide the alarm to the driver when the situation changes, and to brake the train when necessary, thereby guaranteeing the driving safety;
3. RBC equipment has an interlocking function and operates the turnout and other basic signaling equipment by means of a remote control execution unit, and the station only needs to be configured with a differential base station for train positioning, is not provided with a traditional ground signal and track circuit, and has the functions of manual block and virtual automatic block functions between stations;
4. the system is designed as per single track automatic block, section tracking operation can be achieved, and the operation interval can be dynamically adjusted according to the operation demands, so that the operation requirements of ordinary-speed locomotives such as diesel locomotives and electric locomotives are met; and
5. locomotives and rail cars of the whole line are all provided with integrity inspection equipment, and integrity inspection is performed on the train through comparison of the air pressure at the train head and the train tail, which greatly reduces the number of equipment in the station and section and reduces the investment cost in the early stage and the maintenance cost in the later stage.

DETAILED DESCRIPTION OF THE EMBODIMENTS

The technical solution in an embodiment of the present disclosure will be described clearly and completely below in conjunction with the accompanying drawings in the embodiment of the present disclosure. Obviously, the described embodiment is a part of embodiments of the present disclosure, not all of them. On the basis of the embodiment of the present disclosure, all other embodiments obtained by the person of ordinary skill in the art without involving any inventive effort should fall within the scope of protection of the present disclosure.

The principle of the present disclosure is as follows: a light train control system applied to oversea freight railways (hereinafter referred to as the light train control system) is based on research and development achievements of existing train control systems, aims at application demands of freight railways, comprehensively uses technologies of multi-source fusion train autonomous positioning integrating Beidou satellite positioning, electronic maps, integrity detection and wireless communication, achieves efficient system operation, simplified trackside equipment and centralized indoor equipment and meets the automatic block operation requirement. The system is designed as per single track automatic block, section tracking operation can be achieved, and the operation interval can be dynamically adjusted according to the operation demands, so that the operation requirements of ordinary-speed locomotives such as diesel locomotives and electric locomotives are met. The system centralizes functions of station interlocking, section block and train operation control. RBC equipment has an interlocking function and operates the turnout and other basic signaling equipment by means of a remote control execution unit, and the station only needs to be configured with a differential base station for train positioning, is not provided with a traditional ground signal and track circuit, and has the functions of manual block and virtual automatic block functions between stations. Locomotives and rail cars of the whole line should all be provided with integrity inspection equipment, and integrity inspection is performed on the train through comparison of the air pressure at the train head and the train tail, which greatly reduces the number of equipment in the station and section.

Figure 1:
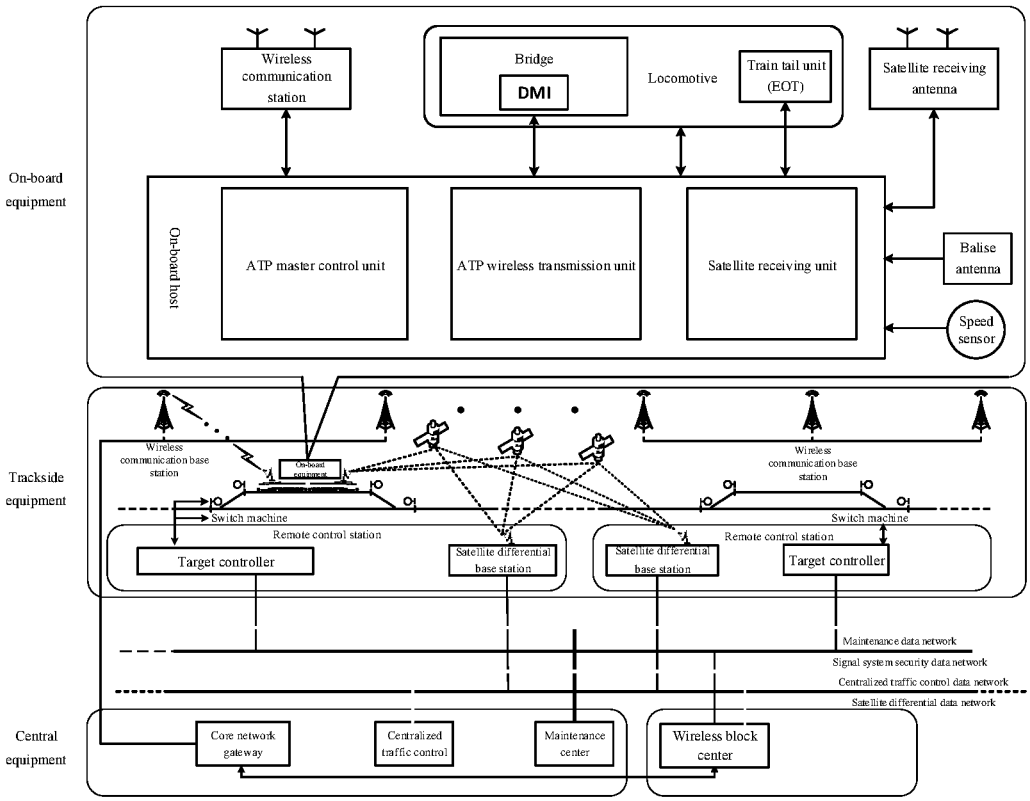
FIG. 1 is a structure diagram of a system of the present disclosure.

As shown in FIG. 1, the light train control system applied to oversea freight railways comprises an on-board subsystem, an RBC subsystem and a satellite positioning differential base station management subsystem, wherein the on-board subsystem is connected to the RBC subsystem and the satellite positioning differential base station management subsystem by means of on-board equipment external interfaces.

Figure 2:
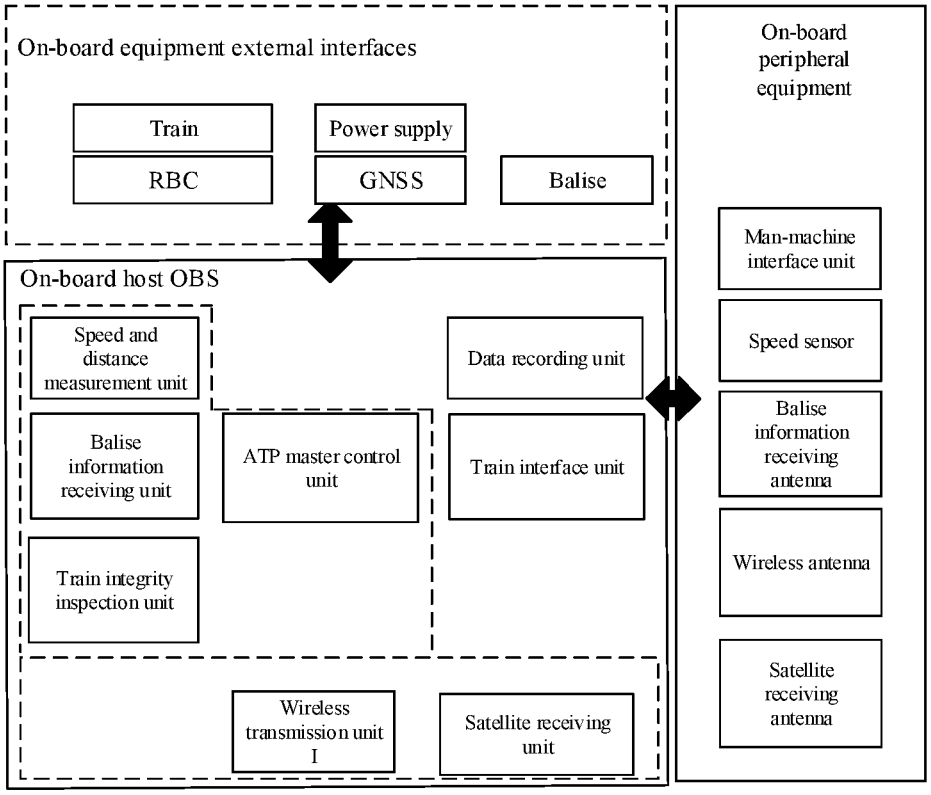
FIG. 2 is a structure diagram of an on-board subsystem of the present disclosure.

As shown in FIG. 2, the on-board subsystem comprises on-board host OBS and on-board peripheral equipment, and the on-board peripheral equipment is connected to the on-board equipment external interfaces by means of the on-board host OBS.

The on-board equipment external interfaces include a train interface, a power interface, an RBC interface, a GNSS interface and a balise interface. The on-board host OBS comprises an ATP master control unit, a speed and distance measurement unit, a balise information receiving unit, a train integrity receiving unit, a data recording unit, a train interface unit, a wireless transmission unit and a satellite receiving unit. The on-board peripheral equipment comprises a man-machine interface unit, the speed sensor, a balise information receiving antenna, a wireless antenna and a satellite receiving antenna.

The on-board host OBS determines the speed and the position by combining satellite information, a balise and a speed sensor to complete autonomous positioning of the train. The on-board host OBS completes train integrity inspection by means of satellite positioning and air pressure detection.

Figure 3:
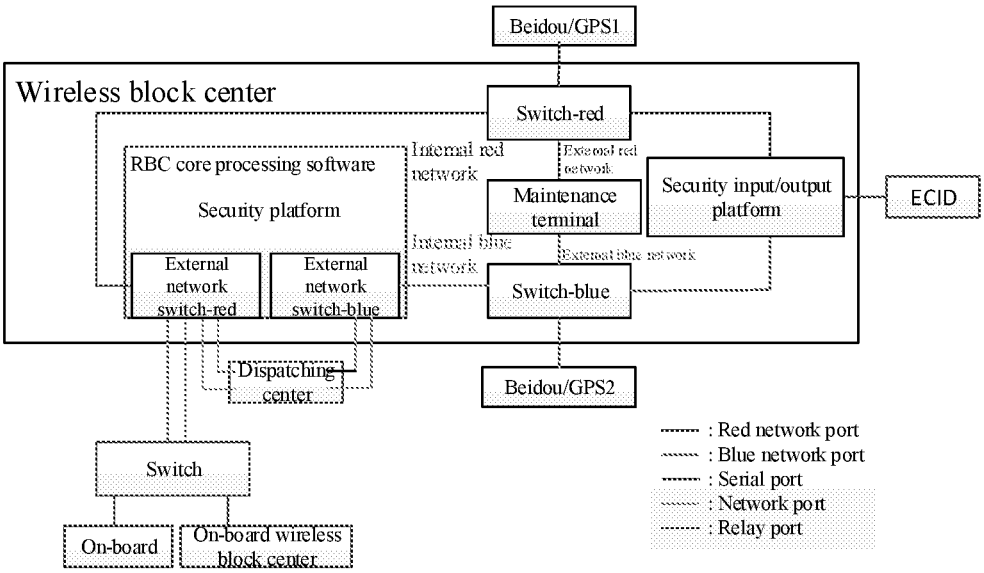
FIG. 3 is a structure diagram of an RBC subsystem of the present disclosure.

As shown in FIG. 3, a radio block center (RBC) sends movement authority to the train through a communication network by means of RBC remote driving, collection of the state of a station turnout, the state of a signal and the state of a track circuit and combination with the stored line data and a position report sent by the station.

Figure 4:
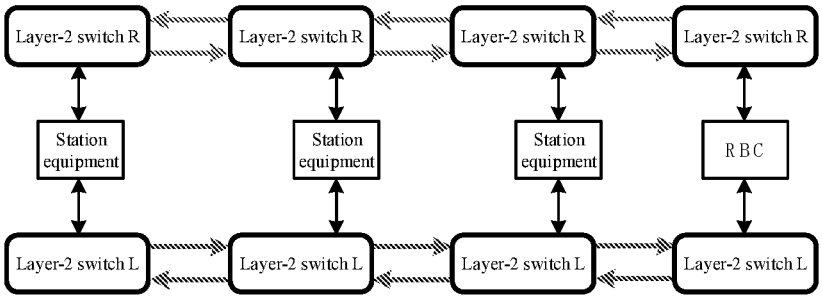
FIG. 4 is a structure diagram of a network of the present disclosure.

As shown in FIG. 4, the system adopts two-way continuous train-ground wireless communication and uses on-board signals as main signals of train operation to control the train operation. The communication network comprises DMR, VHF and TETRA communication modes.

The system realizes the train-ground wireless communication and wireless communication between the on-board equipment and train tail equipment in the low-density freight railways by means of a DMR digital co-frequency relay technology. Digital signals are automatically received and synchronously forwarded on the basis of a DMR co-frequency relay base station, the communication technology is used to ensure timely communication and reduce delay (within 120 ms), and meanwhile, a coverage scheme is flexible, which can not only cover a communication blind area or a weak field area locally, but also cover the whole line.

The system uses balise information as a reference point to report a train position in the station and a section with a balise, and uses a virtual balise as a reference train position report in a section without the balise. The system section is not provided with the track circuit, an axle counter and the signal.

Therefore, the system of the present disclosure adopts the integrated design idea and integrates automatic block, station turnout control and train operation overspeed protection control. The system adopts the two-way continuous train-ground wireless communication and uses the on-board signals as the main signals of the train operation to control the train operation. The system monitors the train operation, so as to provide an alarm to a driver when the situation changes, and to brake the train when necessary, thereby guaranteeing the driving safety. The system uses an electronic map to manage line data of the whole line, achieves dynamic configuration of the transport capacity by means of a virtual block technology, and remotely controls the turnout and other basic signaling equipment by means of the RBC, and the station only needs to be configured with the differential base station for accurate train positioning, which greatly reduces the number of equipment in the station and section and reduces the investment cost in the early stage.

The above is only the detailed description of the embodiment of the disclosure, but the scope of protection of the disclosure is not limited to this. Any technical person familiar with the technical field can easily conceive of various equivalent modifications or replacements within the scope of technologies of the disclosure, and these modifications or replacements should be included in the scope of protection of the disclosure. Therefore, the scope of protection of the disclosure shall be subject to the scope of protection of the claims.

The invention claimed is:

1. A light train control system applied to oversea freight railways, the system integrating automatic block, station turnout control and train operation overspeed protection control and comprising an on-board subsystem, an RBC subsystem and a satellite positioning differential base station management subsystem, wherein the on-board subsystem is respectively connected to the RBC subsystem and the satellite positioning differential base station management subsystem by means of on-board equipment external interfaces;

the light train control system adopts two-way continuous train-ground wireless communication and uses on-board signals as main signals of train operation to control the train operation; meanwhile, the system monitors the train operation, so as to provide an alarm to a driver when the situation changes, and to brake a train when necessary; and the system uses an electronic map to manage line data of a whole line, achieves dynamic configuration of the transport capacity by means of a virtual block technology, and remotely controls basic signaling equipment by means of an RBC, wherein the on-board subsystem comprises on-board host OBS and on-board peripheral equipment, and the on-board peripheral equipment is connected to the on-board equipment external interfaces by means of the on-board host OBS, wherein the on-board host OBS comprises an ATP master control unit and a speed and distance measurement unit, a balise information receiving unit, a train integrity receiving unit, a data recording unit, a train interface unit, a wireless transmission unit and a satellite receiving unit which are respectively connected to the ATP master control unit; and the on-board host OBS determines the speed and the position by combining satellite information, a balise and a speed sensor to measure the speed and the distance, wherein the system realizes the train-ground wireless communication and wireless communication between the on-board host OBS and train tail equipment in the low-density freight railways by means of a DMR digital co-frequency relay technology, and digital signals are received and synchronously forwarded via a DMR co-frequency relay base station to ensure timely communication and to reduce delay.

2. The system according to claim 1, wherein the on-board equipment external interfaces include a train interface, a power interface, an RBC interface, a GNSS interface and a balise interface.

3. The system according to claim 1, wherein the on-board peripheral equipment comprises a man-machine interface unit, a speed sensor, a balise information receiving antenna, a wireless antenna and a satellite receiving antenna.

4. The system according to claim 1, wherein the on-board host OBS completes train integrity inspection by means of satellite positioning and air pressure detection.

5. The system according to claim 1, wherein the RBC subsystem comprises a radio block center (RBC), which sends movement authority to the train through a communication network by means of RBC remote driving, collection of the state of a station turnout, the state of a signal and the state of a track circuit and combination with the stored line data and a position report sent by the station.

6. The system according to claim 5, wherein the communication network comprises DMR, VHF and TETRA communication modes.

7. The system according to claim 1, wherein the system uses balise information as a reference point to report a train position in the station and a section with a balise, and uses a virtual balise as a reference train position report in a section without the balise.

8. The system according to claim 1, wherein the automatic block is a single automatic block.

9. The system according to claim 8, wherein the light train control system does not include a ground signal and track circuit.

10. The system according to claim 9, wherein the RBC is configured to remotely control the turnout.

11. The system according to claim 10, wherein the satellite receiving unit is configured to receive the satellite information from a Beidou satellite.

* * * * *